US011152183B2

(12) United States Patent
Kirz et al.

(10) Patent No.: US 11,152,183 B2
(45) Date of Patent: Oct. 19, 2021

(54) X-RAY SOURCE WITH ROTATING ANODE AT ATMOSPHERIC PRESSURE

(71) Applicant: Sigray, Inc., Concord, CA (US)

(72) Inventors: Janos Kirz, Berkeley, CA (US); William Henry Hansen, Genola, UT (US); Wenbing Yun, Walnut Creek, CA (US)

(73) Assignee: Sigray, Inc., Concord, CA (US)

( * ) Notice: Subject to any disclaimer, the term of this patent is extended or adjusted under 35 U.S.C. 154(b) by 0 days.

(21) Appl. No.: 16/920,520

(22) Filed: Jul. 3, 2020

(65) Prior Publication Data

US 2021/0020398 A1 Jan. 21, 2021

Related U.S. Application Data

(60) Provisional application No. 62/874,298, filed on Jul. 15, 2019.

(51) Int. Cl.

| | |
|---|---|
| ***H01J 35/18*** | (2006.01) |
| ***H01J 35/10*** | (2006.01) |
| ***H01J 35/20*** | (2006.01) |

(52) U.S. Cl.

CPC ..... *H01J 35/18* (2013.01); *H01J 35/106* (2013.01); *H01J 35/20* (2013.01); (Continued)

(58) Field of Classification Search

CPC ..... H01J 2235/1204; H01J 2235/127; H01J 35/1017; H01J 35/106; H01J 35/18; H01J 35/20

See application file for complete search history.

(56) References Cited

U.S. PATENT DOCUMENTS

| | | | |
|---|---|---|---|
| 1,203,495 | A | 10/1916 | Coolidge |
| 1,211,092 | A | 1/1917 | Coolidge |

(Continued)

FOREIGN PATENT DOCUMENTS

| | | | |
|---|---|---|---|
| CN | 102124537 | A | 7/2011 |
| EP | 0432568 | | 6/1991 |

(Continued)

OTHER PUBLICATIONS

Poludniowski et al., "Technical Note: SpekPy v2.0—a software toolkit for modelling x-ray tube spectra," doi: 10.1002/MP.14945 (2021).

(Continued)

*Primary Examiner* — Chih-Cheng Kao

(74) *Attorney, Agent, or Firm* — Knobbe, Martens, Olson & Bear, LLP

(57) ABSTRACT

An x-ray source includes an anode assembly having at least one surface configured to rotate about an axis, the at least one surface in a first region. The x-ray source further includes an electron-beam source configured to emit at least one electron beam configured to bombard the at least one surface of the anode assembly. The electron-beam source includes a housing, a cathode assembly, and a window. The housing at least partially bounds a second region and comprises an aperture. The cathode assembly is configured to generate the at least one electron beam within the second region. The window is configured to hermetically seal the aperture, to maintain a pressure differential between the first region and the second region, and to allow the at least one electron beam to propagate from the second region to the first region.

19 Claims, 3 Drawing Sheets

(52) U.S. Cl.
CPC ... *H01J 35/1017* (2019.05); *H01J 2235/1204* (2013.01); *H01J 2235/127* (2013.01)

(56) References Cited

U.S. PATENT DOCUMENTS 1,215,116 A 2/1917 Coolidge
1,328,495 A 1/1920 Coolidge
1,355,126 A 10/1920 Coolidge
1,790,073 A 1/1931 Pohl
1,917,099 A 7/1933 Coolidge
1,946,312 A 2/1934 Coolidge
2,926,270 A 2/1960 Zunick
3,795,832 A 3/1974 Holland
3,894,239 A * 7/1975 Braun ..... H05G 1/04 378/125
4,165,472 A 8/1979 Wittry
4,192,994 A 3/1980 Kastner
4,227,112 A 10/1980 Waugh et al.
4,266,138 A 5/1981 Nelson et al.
4,523,327 A 6/1985 Eversole
4,573,186 A 2/1986 Reinhold
4,951,304 A 8/1990 Piestrup et al.
4,972,449 A 11/1990 Upadhya et al.
5,148,462 A 9/1992 Spitsyn et al.
5,371,774 A 12/1994 Cerrina
5,416,820 A * 5/1995 Weil ..... H01J 35/107 378/130
5,602,899 A 2/1997 Larson
5,629,969 A 5/1997 Koshishiba
5,657,365 A 8/1997 Yamamoto et al.
5,729,583 A 3/1998 Tang et al.
5,737,387 A 4/1998 Smither
5,825,848 A 10/1998 Virshup et al.
5,857,008 A 1/1999 Reinhold
5,878,110 A 3/1999 Yamamoto et al.
5,978,448 A * 11/1999 Bristol ..... H01J 35/1024 378/132
6,118,853 A 9/2000 Hansen et al.
6,125,167 A 9/2000 Morgan
6,181,773 B1 1/2001 Lee et al.
6,185,277 B1 * 2/2001 Harding ..... H01J 35/186 378/143
6,307,916 B1 10/2001 Rogers et al.
6,377,660 B1 4/2002 Ukita et al.
6,430,260 B1 8/2002 Snyder
6,463,123 B1 10/2002 Korenev
6,487,272 B1 11/2002 Kutsuzawa
6,553,096 B1 4/2003 Zhou et al.
6,560,313 B1 5/2003 Harding et al.
6,560,315 B1 5/2003 Price et al.
6,707,883 B1 3/2004 Tiearney et al.
6,850,598 B1 2/2005 Fryda et al.
6,947,522 B2 9/2005 Wilson et al.
6,975,703 B2 12/2005 Wilson et al.
7,003,077 B2 2/2006 Jen et al.
7,023,950 B1 4/2006 Annis
7,079,625 B2 7/2006 Lenz
7,180,981 B2 2/2007 Wang
7,215,741 B2 5/2007 Ukita et al.
7,218,700 B2 5/2007 Huber et al.
7,218,703 B2 5/2007 Yada et al.
7,330,533 B2 2/2008 Sampayon
7,346,148 B2 3/2008 Ukita
7,349,525 B2 3/2008 Morton
7,359,487 B1 4/2008 Newcome
7,382,864 B2 6/2008 Hebert et al.
7,443,953 B1 10/2008 Yun et al.
7,443,958 B2 10/2008 Harding
7,522,707 B2 4/2009 Steinlage et al.
7,529,343 B2 5/2009 Safai et al.
7,551,722 B2 6/2009 Ohshima et al.
7,601,399 B2 10/2009 Barnola et al.
7,672,433 B2 3/2010 Zhong et al.
7,796,725 B1 9/2010 Yun et al.
7,809,113 B2 10/2010 Aoki et al.
7,813,475 B1 10/2010 Wu et al.
7,817,777 B2 10/2010 Baumann et al.
7,873,146 B2 1/2011 Okunuki et al.
7,876,883 B2 1/2011 O'Hara
7,889,844 B2 2/2011 Okunuki et al.
7,929,667 B1 4/2011 Zhuang et al.
7,991,120 B2 8/2011 Okunuki et al.
8,036,341 B2 11/2011 Lee
8,094,784 B2 1/2012 Morton
8,139,711 B2 3/2012 Takahashi
8,139,716 B2 3/2012 Okunuki et al.
8,208,603 B2 6/2012 Sato
8,243,884 B2 8/2012 Rödhammer et al.
8,306,184 B2 11/2012 Chang et al.
8,331,534 B2 12/2012 Silver
8,360,640 B2 1/2013 Reinhold
8,406,378 B2 3/2013 Wang et al.
8,416,920 B2 4/2013 Okumura et al.
8,422,637 B2 6/2013 Okunuki et al.
8,509,386 B2 8/2013 Lee et al.
8,520,803 B2 8/2013 Behling
8,553,843 B2 10/2013 Drory
8,588,372 B2 11/2013 Zou et al.
8,644,451 B2 2/2014 Aoki et al.
8,666,024 B2 3/2014 Okunuki et al.
8,699,667 B2 4/2014 Steinlage et al.
8,831,179 B2 9/2014 Adler et al.
8,837,680 B2 9/2014 Tsujii
8,861,682 B2 10/2014 Okunuki et al.
8,989,351 B2 3/2015 Vogtmeier et al.
8,995,622 B2 3/2015 Adler et al.
9,008,278 B2 4/2015 Lee et al.
9,020,101 B2 4/2015 Omote et al.
9,029,795 B2 5/2015 Sando
9,251,995 B2 2/2016 Ogura
9,257,254 B2 2/2016 Ogura et al.
9,263,225 B2 2/2016 Morton
9,281,158 B2 3/2016 Ogura
9,362,081 B2 6/2016 Bleuet
9,390,881 B2 7/2016 Yun et al.
9,412,552 B2 8/2016 Aoki et al.
9,448,190 B2 9/2016 Yun et al.
9,449,780 B2 9/2016 Chen
9,449,781 B2 9/2016 Yun et al.
9,502,204 B2 11/2016 Ikarashi
9,520,260 B2 12/2016 Hesselink et al.
9,524,846 B2 12/2016 Sato et al.
9,543,109 B2 1/2017 Yun et al.
9,564,284 B2 2/2017 Gerzoskovitz
9,570,264 B2 2/2017 Ogura et al.
9,570,265 B1 2/2017 Yun et al.
9,594,036 B2 3/2017 Yun et al.
9,595,415 B2 3/2017 Ogura
9,823,203 B2 11/2017 Yun et al.
9,934,930 B2 4/2018 Parker et al.
10,014,148 B2 7/2018 Tang et al.
10,020,158 B2 7/2018 Yamada
10,068,740 B2 9/2018 Gupta
10,105,112 B2 10/2018 Utsumi
10,115,557 B2 10/2018 Ishii
10,217,596 B2 2/2019 Liang et al.
10,264,659 B1 4/2019 Miller et al.
10,269,528 B2 4/2019 Yun et al.
10,297,359 B2 5/2019 Yun et al.
10,743,396 B1 8/2020 Kawase
10,841,515 B1 11/2020 Tsujino
2002/0085676 A1 7/2002 Snyder
2003/0142790 A1 1/2003 Zhou et al.
2004/0076260 A1 4/2004 Charles, Jr.
2004/0120463 A1 6/2004 Wilson et al.
2004/0140432 A1 7/2004 Maldonado et al.
2005/0074094 A1 4/2005 Jen et al.
2005/0123097 A1 6/2005 Wang
2005/0201520 A1 9/2005 Smith et al.
2006/0233309 A1 10/2006 Kutzner et al.
2007/0071174 A1 3/2007 Hebert et al.
2007/0110217 A1 5/2007 Ukita
2007/0248215 A1 10/2007 Ohshima et al.
2008/0084966 A1 4/2008 Aoki et al.

(56) References Cited

U.S. PATENT DOCUMENTS

2008/0089484 A1 4/2008 Reinhold
2008/0137812 A1* 6/2008 Frontera ..... H01J 35/1017 378/130
2008/0170668 A1 7/2008 Kruit et al.
2009/0154640 A1 6/2009 Baumann et al.
2009/0316860 A1 12/2009 Okunuki et al.
2010/0027739 A1 2/2010 Lantz et al.
2010/0040202 A1 2/2010 Lee
2010/0141151 A1 6/2010 Reinhold
2010/0201240 A1* 8/2010 Heinke ..... H05G 2/00 313/35
2011/0026680 A1 2/2011 Sato
2011/0038455 A1 2/2011 Silver et al.
2011/0058655 A1 3/2011 Okumura et al.
2011/0064202 A1 3/2011 Thran et al.
2011/0135066 A1 6/2011 Behling
2011/0142204 A1 6/2011 Zou et al.
2011/0235781 A1 9/2011 Aoki et al.
2012/0057669 A1 3/2012 Vogtmeier et al.
2012/0163547 A1 6/2012 Lee et al.
2012/0269323 A1 10/2012 Adler et al.
2012/0269324 A1 10/2012 Adler
2012/0269325 A1 10/2012 Adler et al.
2012/0269326 A1 10/2012 Adler et al.
2013/0108012 A1 5/2013 Sato
2013/0195246 A1 8/2013 Tamura et al.
2013/0223594 A1 8/2013 Sprang et al.
2013/0235976 A1 9/2013 Jeong et al.
2013/0259207 A1 10/2013 Omote et al.
2013/0308754 A1 11/2013 Yamazaki et al.
2014/0029729 A1 1/2014 Kucharczyk
2014/0079188 A1 3/2014 Hesselink et al.
2014/0177800 A1 6/2014 Sato et al.
2014/0185778 A1 7/2014 Lee et al.
2014/0211919 A1 7/2014 Ogura et al.
2014/0369469 A1 12/2014 Ogura et al.
2014/0369471 A1 12/2014 Ogura et al.
2015/0030127 A1 1/2015 Aoki et al.
2015/0043713 A1 2/2015 Chen
2015/0071402 A1 3/2015 Handa
2015/0092923 A1* 4/2015 Iida ..... H01J 35/04 378/138
2015/0092924 A1 4/2015 Yun et al.
2015/0110252 A1 4/2015 Yun et al.
2015/0194287 A1 7/2015 Yun et al.
2015/0243397 A1 8/2015 Yun et al.
2015/0247811 A1 9/2015 Yun et al.
2015/0260663 A1 9/2015 Yun et al.
2015/0357069 A1 12/2015 Yun et al.
2016/0064175 A1 3/2016 Yun et al.
2016/0066870 A1 3/2016 Yun et al.
2016/0106387 A1 4/2016 Kahn
2016/0178540 A1 6/2016 Yun et al.
2016/0268094 A1 9/2016 Yun et al.
2016/0320320 A1 11/2016 Yun et al.
2016/0351370 A1 12/2016 Yun et al.
2017/0018392 A1 1/2017 Cheng
2017/0047191 A1 2/2017 Yun et al.
2017/0162288 A1 6/2017 Yun et al.
2017/0162359 A1 6/2017 Tang et al.
2017/0261442 A1 9/2017 Yun et al.
2018/0144901 A1 5/2018 Yun et al.
2018/0202951 A1 7/2018 Yun et al.
2018/0323032 A1 11/2018 Strelec et al.
2019/0017942 A1 1/2019 Filevich
2019/0019647 A1 1/2019 Lee et al.
2019/0057832 A1 2/2019 Durst et al.
2019/0088439 A1 3/2019 Honda
2019/0115184 A1 4/2019 Zalubovsky
2019/0131103 A1 5/2019 Tuohimaa
2019/0132936 A1 5/2019 Steck et al.
2019/0148102 A1* 5/2019 Maltz ..... H01J 35/18 378/130
2019/0189385 A1 6/2019 Liang et al.
2019/0214216 A1 7/2019 Jeong et al.
2019/0304735 A1 10/2019 Safai et al.
2019/0311874 A1 10/2019 Tuohimma et al.
2019/0341219 A1 11/2019 Zhang et al.
2019/0341220 A1 11/2019 Parker et al.
2019/0380193 A1 12/2019 Matsuhana et al.
2019/0387602 A1 12/2019 Woywode et al.
2020/0041429 A1 2/2020 Cho et al.
2020/0058462 A1 2/2020 Suzuki
2020/0105492 A1 4/2020 Behling et al.
2020/0154552 A1 5/2020 Suzuki et al.
2020/0163195 A1 5/2020 Steck et al.
2020/0168427 A1 5/2020 Krokhmal et al.
2020/0187339 A1 6/2020 Freudenberger et al.
2020/0194212 A1 6/2020 Dalakos et al.
2020/0203113 A1 6/2020 Ponard
2020/0234908 A1 7/2020 Fishman et al.
2020/0305809 A1 10/2020 Schwoebel et al.
2020/0321184 A1 10/2020 Parker et al.
2020/0388461 A1 12/2020 Behling et al.

FOREIGN PATENT DOCUMENTS

EP 1028451 8/2000
EP 3093867 A1 11/2016
FR 2548447 1/1985
JP H06-188092 7/1994
JP H07-056000 3/1995
JP 2000-306533 11/2000
JP 2003-288853 10/2003
JP 2004-089445 3/2004
JP 2004-518262 6/2004
JP 2007-265981 10/2007
JP 2007-311185 11/2007
JP 2008-145111 6/2008
JP 2009-195349 3/2009
JP 2009-212058 9/2009
JP 2011-029072 2/2011
JP 2013-157269 8/2013
JP 2013-160637 8/2013
JP 2013-239317 11/2013
JP 2015-002074 1/2015
WO WO 1995/006952 3/1995
WO WO 1998/011592 3/1998
WO WO 2002/039792 5/2002
WO WO 2003/081631 10/2003
WO WO 2005/109969 11/2005
WO WO 2006/096052 9/2006
WO WO 2009/098027 8/2009
WO WO 2010/109909 9/2010
WO WO 2013/118593 8/2013
WO WO 2013/168468 11/2013
WO WO 2014/054497 4/2014
WO WO 2015/016019 2/2015
WO WO 2015/034791 3/2015
WO WO 2015/084466 6/2015
WO WO 2015/152490 10/2015
WO WO 2015/187219 12/2015
WO WO 2017/204850 11/2017

OTHER PUBLICATIONS

Behling, "Medical X-ray sources Now and for the Future," Nucl. Inst, and Methods in Physics Research A 873, pp. 43-50 (2017).
Bjeoumikhov et al., "A modular system for XRF and XRD applications consisting of a microfocus X-ray source and different capillary optics," X-ray Spectrometry, vol. 33 (2004), pp. 312-316.
Chervenak et al., "Experimental thick-target bremsstrahlung spectra from electrons in the range 10 to 30 keV", Phys. Rev. A vol. 12 (1975), pp. 26-33.
Gonzales et al., "Angular distribution of thick-target bremsstrahlung produced by electrons with initial energies ranging from 10 to 20 keV incident on Ag", Phys. Rev. A vol. 84 (2011): 052726.
Gonzales et al., "Angular Distribution of Bremsstrahlung Produced by 10-Kev And 20 Kev Electrons Incident On A Thick Au Target", in Application of Accelerators in Research and Industry, AIP Conf. Proc. 1221 (2013), pp. 114-117.

(56) References Cited

OTHER PUBLICATIONS

Hasse et al., "New developments in laboratory-based x-ray sources and optics," Adv. In Laboratory-based X-Ray Sources, Optics, and Applications VI, ed. A.M. Khounsary, Proc. SPIE vol. 10387, 103870B-1 (2017).
Ihsan et al., "A microfocus X-ray tube based on a microstructured X-ray target", Nuclear Instruments and Methods in Physics Research B vol. 267 (2009) pp. 3566-3573.
Jin et al., "Development of an X-ray tube with two selective targets modulated by a magnetic field," Rev. Sci. Inst. vol. 90, 083105 (2019).
Langhoff et al., "X-ray Sources," Ch. 2 of "Handbook of Practical X-Ray Fluorescence Analysis," B. Beckhoff et al., eds. (Springer, Berlin Heidelberg New York, 2006), pp. 33-82.
Li et al., "Study on High Thermal Conductivity of X-ray Anode with Composite Diamond Substrate," J. Phys.: Conf. Ser., vol. 1300, 012115 (2019).
Li et al., "Production and Heat Properties of an X-ray Reflective Anode Based on a Diamond Heat Buffer Layer," Materials vol. 13, p. 241 (2020).
Morimoto et al., "Development of multiline embedded X-ray targets for X-ray phase contrast imaging," XTOP 2012 Book of Abstracts, (Ioffe Physical-Technical Institute of the Russian Academy of Sciences, St. Petersburg, Russia, 2012), pp. 74-75.
Nojeh, "Carbon Nanotube Electron Sources: From Electron Beams to Energy Conversion and Optophononics", ISRN Nanomaterials vol. 2014 (2014): 879827.
Otendal et al., A 9 keV electron-impact liquid-gallium-jet x-ray source, Rev. Sci. Instrum. vol. 79 (2008): 016102.
Oxford Instruments Inc., Series 5000 Model XTF5011 X-ray Tube information, Jun. 1998, 3 pages.
Riege, "Electron Emission from Ferroelectrics—A Review", CERN Report CERN AT/93-18 (CERN, Geneva, Switzerland, Jul. 1993).
Scholz, "X-ray Tubes and Monochromators," Technical Workshop EPIC, Universität Würzburg (2007); 41 slides, 2007.
Shimura et al., "Hard x-ray phase contrast imaging using a tabletop Talbot-Lau interferometer with multiline embedded x-ray targets", Opt. Lett. vol. 38(2) (2013), pp. 157-159.
Stupple et al., "Modeling of Heat Transfer in an Aluminum X-Ray Anode Employing a Chemical Vapor Deposited Diamond Heat Spreader," J. Heat Transfer, Vo. 140,124501-1-5 (Dec. 2018).
Tucker, "Design of X-Ray Source for Real-Time Computed Tomography," Dissertation, Missouri Univ. of Sci. and Tech., Scholars' Mine, 104 pages (2020).
Wang et al., "High beam-current density of a 10-keV nano-focus X-ray source," Nucl. Inst. And Meth. A940, 475-478 (2019).
Wansleben et al., "Photon flux determination of a liquid-metal jet x-ray source by means of photon scattering," arXiv:1903.06024v1, Mar. 14, 2019.
Yamamoto, "Fundamental physics of vacuum electron sources", Reports on Progress in Physics vol. 69, (2006), pp. 181-232.
Zhou et al., "A study of new type electric field modulation multi-target X-ray source," Nucl. Inst. and Methods in Physics Research A, https://doi.org/10.1016/j.nima.2020.164342 (2020).

* cited by examiner

X-RAY SOURCE WITH ROTATING ANODE AT ATMOSPHERIC PRESSURE

CLAIM OF PRIORITY

The present application claims the benefit of priority to U.S. Provisional Appl. No. 62/874,298, filed Jul. 15, 2019, which is incorporated in its entirety by reference herein.

BACKGROUND

Field

The present application relates generally to systems and methods for generating x-rays.

Description of the Related Art

Conventional x-ray sources generate x-rays by bombarding a target with an electron beam, however, the target can be degraded (e.g., damaged) by the heat generated by being bombarded by an electron beam with a high current density. As a result, such conventional x-ray sources suffer from x-ray brightness limitations resulting from keeping the electron current density below a predetermined level to avoid thermal damage.

Several approaches have previously been used to overcome the x-ray brightness limitations. For rotating anode x-ray sources (e.g., marketed by Rigaku Corp. of Tokyo, Japan), an anode disk rapidly rotates while under vacuum and different regions of the anode disk along a circular track are sequentially irradiated by the electron beam, thereby distributing the heat load over the circular track. In addition, the anode disk is cooled by coolant (e.g., water) flowing through cooling channels in the anode disk. A challenge in such rotating anode x-ray sources is to provide a rotating seal around the rapidly rotating shaft which maintains the vacuum in which the anode disk resides while also coupling the coolant lines through the rotating seal. An additional challenge is that ball bearings in such rotating anodes cannot be lubricated through conventional means, such as organic lubricants, because such lubricants will volatize in vacuum. Moreover, due to minimum requirements for the air gaps (e.g., at least 3 mm) for the vacuum envelope motors, the magnetic driving induction utilizes higher powers to overcome a large magnetic resistance.

For liquid metal jet x-ray sources (e.g., marketed by Excillum AB of Kista, Sweden), instead of a solid anode, a jet of liquid metal (e.g., alloy of Ga, In, and in some cases, Sn) is bombarded by the electron beam. Such x-ray sources have limitations resulting from the evaporation of the metal (e.g., contamination of the vacuum chamber), and from the limited choice of target materials and their spectral characteristics.

For microstructural target anode x-ray sources (e.g., marketed by Sigray, Inc. of Concord Calif.), x-ray generating microstructures are formed on high thermal conductivity substrates (e.g., diamond) and these microstructures are bombarded by the electron beam. While such x-ray sources provide a wide choice of anode materials, and in many cases higher x-ray brightness than do other x-ray sources, thermal damage to the anode target caused by high heat loads still limits the x-ray brightness.

SUMMARY

In one aspect disclosed herein, an x-ray source comprises an anode assembly comprising at least one surface configured to rotate about an axis, the at least one surface in a first region. The x-ray source further comprises an electron-beam source configured to emit at least one electron beam configured to bombard the at least one surface of the anode assembly. The electron-beam source comprises a housing, a cathode assembly, and a window. The housing at least partially bounds a second region and comprises an aperture. The cathode assembly is configured to generate the at least one electron beam within the second region. The window is configured to hermetically seal the aperture, to maintain a pressure differential between the first region and the second region, and to allow the at least one electron beam to propagate from the second region to the first region.

DETAILED DESCRIPTION

Figure 1A:
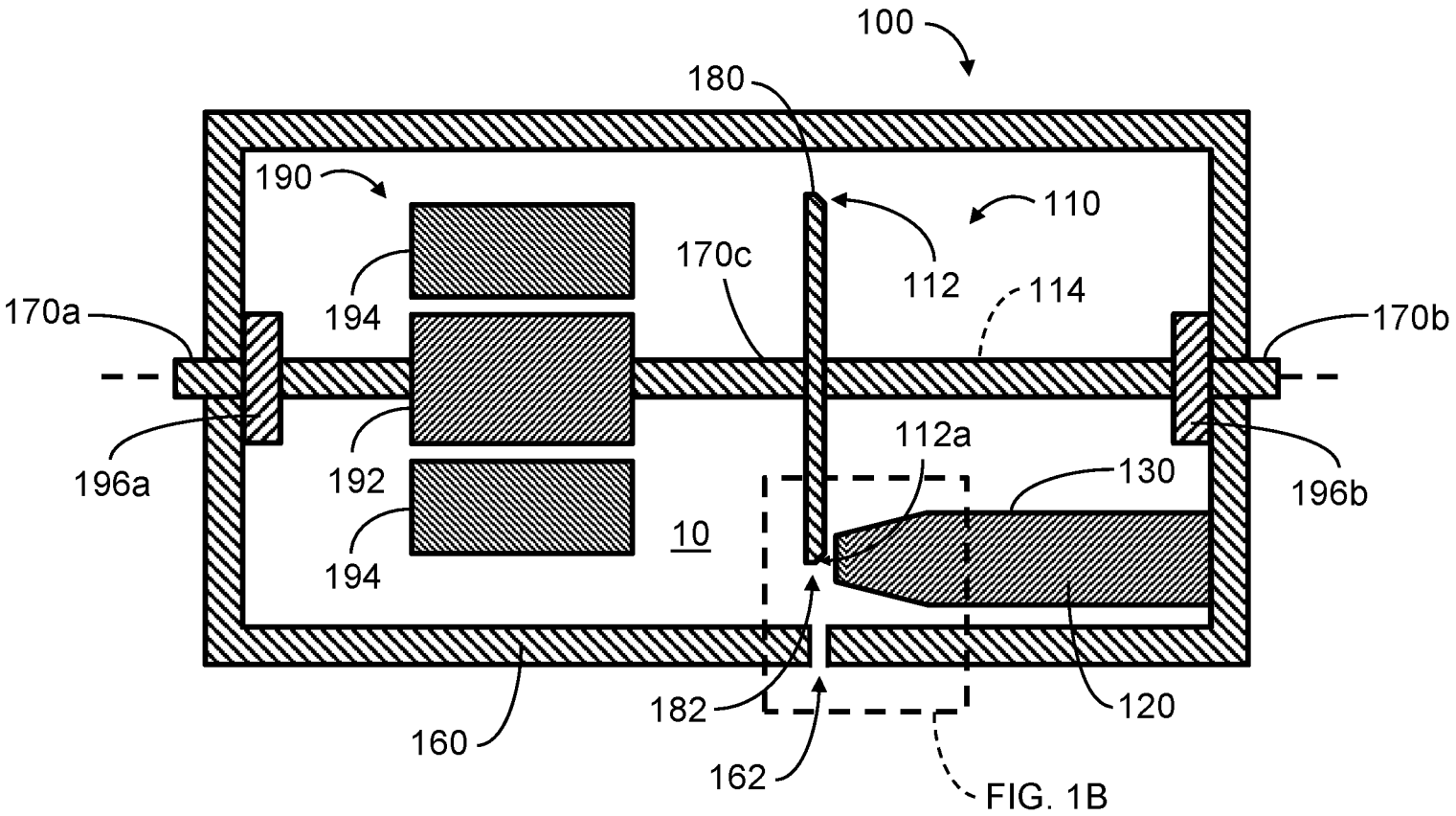
FIGS. 1A and 1B schematically illustrate an example x-ray source in accordance with certain embodiments described herein.
Figure 1B:
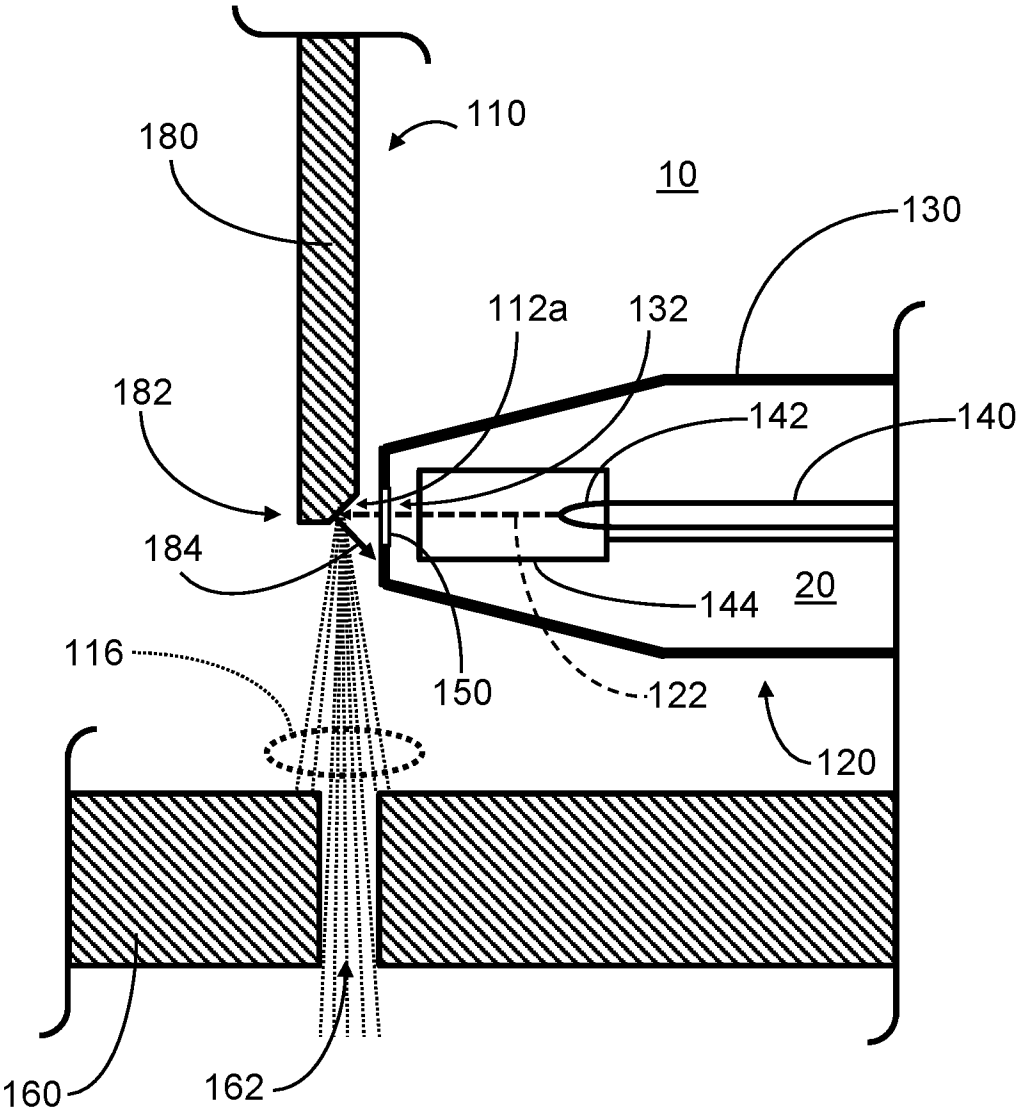

FIGS. 1A and 1B schematically illustrate an example x-ray source 100 in accordance with certain embodiments described herein. The x-ray source 100 comprises an anode assembly 110 comprising at least one surface 112 configured to rotate about an axis 114. The at least one surface 112 is in a first region 10. The x-ray source 100 further comprises an electron-beam source 120 configured to emit at least one electron beam 122 configured to bombard the at least one surface 112 of the anode assembly 110. The electron-beam source 120 comprises a housing 130 at least partially bounding a second region 20 and comprising an aperture 132. The electron-beam source 120 further comprises a cathode assembly 140 configured to generate the at least one electron beam 122 within the second region 20. The electron-beam source 120 further comprises a window 150 configured to hermetically seal the aperture 132, to maintain a pressure differential between the first region 10 and the second region 20, and to allow the at least one electron beam 122 to propagate from the second region 20 to the first region 10. In certain embodiments, the at least one surface 112 is configured to emit x-rays 116 in response to being bombarded by the at least one electron beam 122 from the electron-beam source 120. In certain embodiments, the x-ray source 100 is configured for continuous x-ray generation, while in certain other embodiments, the x-ray source 100 is configured for pulsed x-ray generation.

In certain embodiments, the first region 10 comprises air, nitrogen, and/or helium at or near atmospheric pressure (e.g., in a range of 0.8 atmosphere to 1 atmosphere) or low vacuum (e.g., less than atmospheric pressure and greater than 10 Torr) and the second region 20 is at a pressure (e.g., less than $10^{-6}$ Torr; less than $10^{-8}$ Torr; less than $10^{-9}$ Torr) lower than the pressure of the first region 10. As schematically illustrated by FIG. 1A, the x-ray source 100 of certain embodiments comprises an enclosure 160 (e.g., chamber) at least partially bounding the first region 10 (e.g., substantially surrounding the first region 10) and containing the anode assembly 110 and the electron-beam source 120. The enclosure 160 can be substantially opaque to the x-rays 116 emitted from the at least one surface 112, such that the enclosure 160 serves as a radiation shield configured to prevent unwanted x-ray irradiation from the enclosure 160.

The enclosure 160 can comprise a portion 162 (e.g., orifice; window) that is substantially transparent to at least some of the x-rays 116, such that the portion 162 serves as a port through which at least some of the x-rays 116 are emitted by the x-ray source 100.

In certain embodiments, as schematically illustrated by FIG. 1A, the anode assembly 110 comprises a shaft 170 configured to rotate about the axis 114 and an anode 180 mechanically coupled to the shaft 170. The shaft 170 and the anode 180 comprise a strong structural material (e.g., steel; aluminum) with dimensions sufficient for the shaft 170 and the anode 180 to withstand being rapidly rotated (e.g., at a rate in a range of 3,000 to 15,000 rotations per minute) about the axis 114 without damage. For example, the anode 180 can have a circular disk shape or a circular cylindrical shape that is concentric with the axis 114.

In certain embodiments, the rotating anode 180 comprises the at least one surface 112. In certain embodiments, as schematically illustrated by FIGS. 1A and 1B, the at least one surface 112 is on an edge portion 182 (e.g., a beveled edge) of the rotating anode 180 with a surface normal 184 at a non-zero angle (e.g., in a range of 5 degrees to 80 degrees; in a range of 40 degrees to 50 degrees; about 45 degrees; in a range of 2 degrees to 10 degrees) relative to the axis 114 and/or to the at least one electron beam 112.

In certain embodiments, the at least one surface 112 comprises at least one material configured to emit x-rays having a predetermined spectrum in response to being bombarded by the at least one electron beam 122. For example, the at least one surface 112 can comprise at least one layer (e.g., coating) having a ring-like shape around the axis 114, a thickness in a range of 3 microns to 100 microns (e.g., in a range of 10 microns to 100 microns; in a range of 5 microns to 25 microns), a ring width (e.g., in a direction parallel to the at least one surface 112) in a range of 1 millimeter to 250 millimeters (e.g., a range of 1 millimeter to 10 millimeters; in a range of 10 millimeters to 55 millimeters; in a range of 1 millimeter to 100 millimeters; in a range of 60 millimeters to 250 millimeters), and comprising one or more of: aluminum, chromium, copper, gold, molybdenum, tungsten, tantalum, titanium, platinum, rhenium, rhodium, silicon carbide, tantalum carbide, titanium carbide, boron carbide, or a combination thereof. For another example, the at least one surface 112 of the rotating anode 180 can comprise a plurality of discrete microstructures distributed on or within the at least one surface 112. Example rotating anodes 180 compatible with certain embodiments described herein are described more fully in U.S. Pat. Nos. 9,390,881, 9,543,109, 9,823,203, 10,269,528, and 10,297,359, each of which is incorporated in its entirety by reference herein.

In certain embodiments, the at least one surface 112 comprises at least one coating or at least one strip (e.g., multiple thin strips) of the x-ray generating material on a second high thermal conductivity material, such as diamond or copper. The at least one coating or at least one strip can further comprise one or more additional interface layers between the x-ray generating material and the second material (e.g., titanium nitride; titanium carbide; boron carbide; silicon carbide; or any combination thereof) and having a thickness in a range of 1 nanometer to 5 nanometers. These interface layer materials can serve one or more purposes, such as improved adhesion, anti-diffusion, and/or improved thermal performance. The second material can comprise the substrate or can be layered on a supporting substrate, such as copper or graphite. Such substrates can have thicknesses in a range of 5 millimeters to 20 millimeters.

In certain embodiments, as schematically illustrated by FIG. 1A, the anode assembly 110 further comprises at least one motor 190 mechanically coupled to the shaft 170 and configured to rotate the shaft 170 and the anode 180. For example, as schematically illustrated in FIG. 1A, the at least one motor 190 comprises at least one rotor 192 mechanically coupled to the shaft 170 and at least one stator 194 in magnetic communication with the at least one rotor 192 and configured to be energized to rotate the at least one rotor 192 about the axis 114. While FIG. 1A schematically illustrates an example x-ray source 100 in which the at least one rotor 192 and the at least one stator 194 are in the first region 10 within the enclosure 160, in certain other examples, the at least one stator 194 is outside the enclosure 160 or both the at least one stator 194 and the at least one rotor 192 are outside the enclosure 160.

The anode assembly 110 of certain embodiments can further comprise a plurality of bearing assemblies 196 (e.g., mechanically coupled to the enclosure 160; comprising portions of the enclosure 160) configured to support the shaft 170. For example, as schematically illustrated in FIG. 1A, the plurality of bearing assemblies 196 can comprise a first bearing assembly 196*a* coupled to a first portion 170*a* of the shaft 170 and a second bearing assembly 196*b* coupled to a second portion 170*b* of the shaft 170, with the anode 180 mechanically coupled to a third portion 170*c* of the shaft 170 between the first portion 170*a* and the second portion 170*b*. In other examples, the first bearing assembly 196*a* and the second bearing assembly 196*b* can be on the same side of the shaft 170 (e.g., the anode 180 is not between the first and second bearing assemblies 196*a,b*). In certain embodiments, the bearing assemblies 196 comprise ball bearings that are disposed between at least one bearing fitting face and the rotary shaft 170 and that are lubricated by solid powders (e.g., silver, lead, etc.), organic lubricants, or liquid metal lubricants. In certain other embodiments, the bearing assemblies 196 comprise liquid-driven bearings, such as spiral groove bearings.

In certain embodiments, convective cooling of the anode 180 by the gas within the first region 10 is sufficient to prevent thermal damage to the anode 180. For example, the anode 180 can comprise cooling structures (e.g., fins; protrusions separated by grooves) configured to convectively transmit heat away from the anode 180 into the first region 10. In certain other embodiments, the x-ray source 100 further comprises a cooling subsystem (not shown) in thermal communication with the anode 180, the cooling subsystem configured to remove heat from the at least one surface 112 (e.g., at a rate in a range of 100 watts to 5 kilowatts; at a rate in a range of 50 watts to 2 kilowatts). For example, the cooling subsystem can comprise a nozzle (e.g., liquid jet cooling) configured to spray coolant (e.g., water; ethylene glycol; air; helium) onto the at least one surface 112 (e.g., onto a portion of the at least one surface 112 away from the portion 112*a* of the at least one surface 112 currently being bombarded by the at least one electron beam 122 so as to avoid the coolant from interfering with the east one electron beam 122). For another example, the cooling subsystem can comprise one or more channels extending along the shaft 170 and within the anode 180, the one or more channels configured to allow coolant (e.g., water; ethylene glycol; air; helium) to flow through the channels in thermal communication with the anode 180 and to remove heat from the anode 180. In certain such embodiments, the coolant flowing through the one or more channels is recirculated (e.g., in a closed-loop cooling subsystem in which the coolant heated by the anode 180 is subsequently cooled by a chiller and returned to flow through the one or more channels). In certain embodiments, the cooling subsystem is configured to also cool at least a portion of the electron-beam source 120. For other examples, the cooling subsystem can comprise one or more heat pipes or other structures configured to remove heat from the anode 180.

In certain embodiments, as schematically illustrated by FIG. 1B, the electron-beam source 120 comprises an electron gun and the cathode assembly 140 comprises at least one cathode 142 (e.g., at least one electron emitter including but not limited to tungsten spiral wires or filaments, carbon nanotubes, dispensers, etc.) and an electron optics subsystem 144. The at least one cathode 142 and the electron optics subsystem 144 can be configured to be in electrical communication with control electronics outside the enclosure 160 via one or more electrical feedthroughs (not shown). The at least one cathode 142 is configured to emit electrons and the electron optics subsystem 144 comprises one or more grids and/or electrodes configured to direct, accelerate, and/or shape the emitted electrons to form the at least one electron beam 122 that is emitted from the cathode assembly 140. In certain embodiments, the cathode assembly 140 is at a high negative voltage relative to a voltage of the anode 180 (e.g., the cathode assembly 140 at a voltage in a range of −12 kV to −120 kV or in a range of −10 kV to −160 kV while the anode 180 is at ground). In certain such embodiments, the housing 130 of the electron-beam source 120 is at ground.

Figure 2B:
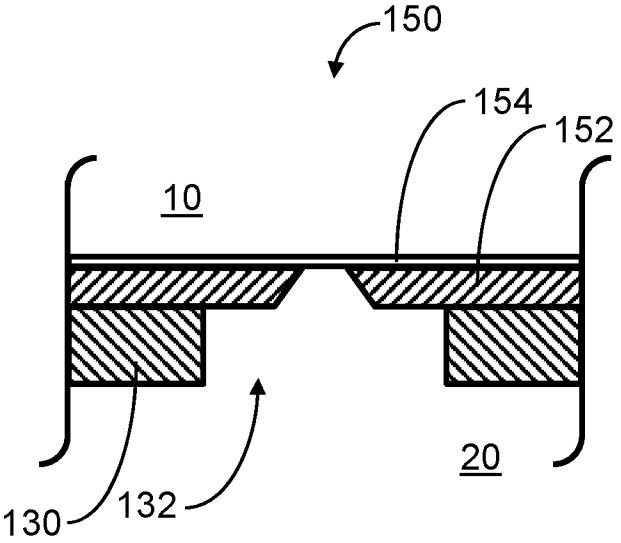
FIGS. 2A and 2B schematically illustrates cross-sectional views of example apertures and example windows in accordance with certain embodiments described herein.
Figure 2A:
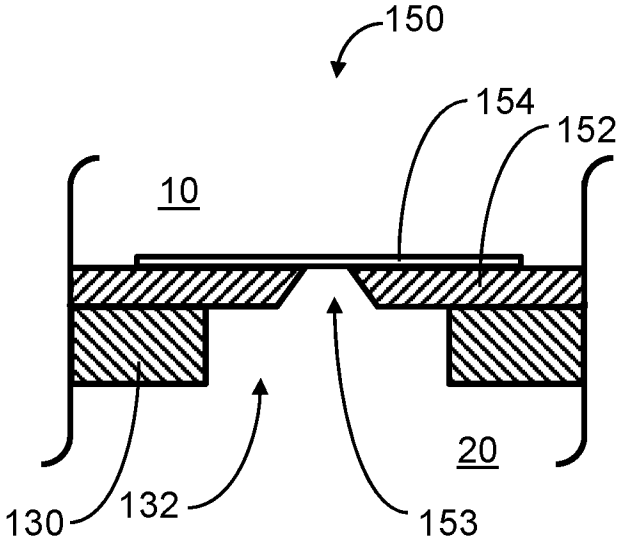

FIGS. 2A and 2B schematically illustrates cross-sectional views of example apertures 132 and example windows 150 in accordance with certain embodiments described herein. In both FIGS. 2A and 2B, the window 150 covers the aperture 132 and is mechanically coupled (e.g., brazed; soldered; epoxied) to the housing 130 so as to form a vacuum seal (hermetic seal between the first region 10 and the second region 20). In certain embodiments, the window 150 is spaced from the at least one surface 112 by a distance in a range of 0.5 millimeter to 10 millimeters (e.g., in a range of 1 millimeter to 5 millimeters; in a range of 0.5 millimeter to 2 millimeter; in a range of 3 millimeters to 10 millimeters). In certain embodiments, the window 150 is across from the spot at which the at least one electron beam 122 bombards the at least one surface 112, which is the spot at which the anode 180 is hottest, and the window 150 is configured to withstand the radiated heat from this spot.

In certain embodiments, the aperture 132 of the housing 130 of the electron-beam source 120 has an area in a range of 1 $mm^2$ to 900 $mm^2$ or in a range of 9 $mm^2$ to 900 $mm^2$ (e.g., having a square, rectangular, circular, or oval shape; having a width in a range of 3 mm to 30 mm). The window 150 of certain embodiments comprises a frame 152 (e.g., silicon; metal; copper; steel) configured to be mechanically coupled (e.g., brazed; soldered; epoxied) to a portion of the housing 130 surrounding the aperture 132 to form a vacuum seal between the housing 130 and the window 150 (e.g., hermetic seal between the first region 10 and the second region 20). The material of the frame 152 can have a coefficient of thermal expansion that is substantially equal to a coefficient of thermal expansion of the window 150.

The window 150 of certain embodiments further comprises an electron-transmissive portion 154 configured to allow at least a portion of the electrons generated by the cathode assembly 140 to be transmitted from the electron-beam source 120 in the second region 20 to bombard the anode 180 in the first region 10. For example, the electron-transmissive portion 154 can comprise at least one material in the group consisting of: diamond, silicon, silicon oxide, silicon nitride, quartz, boron nitride, boron carbide, beryllium, titanium, aluminum, and a combination of two or more thereof. For materials that are susceptible to electron charging, the materials can be doped to provide electrical conductivity and/or the window 150 can further comprise a thin conductive coating. The electron-transmissive portion 154 can have a thickness in a range of 0.1 micron to 10 microns or a range of 0.3 micron to 10 microns, an area in a range of 100 square microns to $4\times10^6$ square microns (e.g., having a square, rectangular, circular, or oval shape; having a width in a range of 10 microns to 2000 microns or a range of 10 microns to 200 microns). Certain other embodiments utilize thinner windows (e.g., thickness in a range of 1 nanometer to 5 nanometers) supported by grids that form a support layer (see, e.g., U.S. Pat. No. 6,803,570). Commercial suppliers of windows 150 compatible with certain embodiments described herein include, but are not limited to, Silson Ltd. of Warwickshire, United Kingdom, Diamond Materials GmbH of Freiburg, Germany, and Materion Corp. of Mayfield Heights, Ohio.

In certain embodiments, as schematically illustrated by FIG. 2A, the frame 152 can comprise an orifice 153 and the electron-transmissive portion 154 (e.g., comprising a different material from the material of the frame 152; comprising the same material as the frame 152) can be mechanically coupled (e.g., brazed; soldered; epoxied) to a portion of the frame 152 surrounding the orifice 153 to form a vacuum seal between the frame 152 and the electron-transmissive portion 154 (e.g., hermetic seal between the first region 10 and the second region 20). For example, the electron-transmissive portion 154 can comprise $Si_3N_4$ and the frame 152 can comprise quartz, or beryllium and steel. A beryllium window 150 can be formed by rolling a thin beryllium foil from a thicker layer and mechanically coupling (e.g., brazing; soldering; epoxying) the thin beryllium foil to the portion of the frame 152 surrounding the orifice 153 so as to cover and seal the orifice 153.

In certain other embodiments, as schematically illustrated by FIG. 2B, the electron-transmissive portion 154 comprises a portion of the frame 152 that has been thinned to a predetermined electron-transmissive thickness. For example, the electron-transmissive portion 154 can comprise a membrane (e.g., comprising silicon nitride or diamond) and the frame 152 can comprise silicon. The window 150 can be formed by forming a thin, uniform membrane layer over a thicker silicon substrate and using microlithography techniques to selectively chemically etch away the silicon substrate in a region below the membrane layer while the membrane layer remains as the electron-transmissive portion 154.

Various configurations have been described above. Although this invention has been described with reference to these specific configurations, the descriptions are intended to be illustrative of the invention and are not intended to be limiting. Various modifications and applications may occur to those skilled in the art without departing from the true spirit and scope of the invention. Thus, for example, in any method or process disclosed herein, the acts or operations making up the method/process may be performed in any suitable sequence and are not necessarily limited to any particular disclosed sequence. Features or elements from various embodiments and examples discussed above may be combined with one another to produce alternative configurations compatible with embodiments disclosed herein. Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

What is claimed is:

1. An x-ray source comprising:

an anode assembly comprising at least one surface configured to rotate about an axis, the at least one surface in a first region;

an electron-beam source configured to emit at least one electron beam configured to bombard the at least one surface of the anode assembly, the electron-beam source comprising:

a housing at least partially bounding a second region, the housing comprising an aperture;

a cathode assembly configured to generate the at least one electron beam within the second region; and a window configured to hermetically seal the aperture, to maintain a pressure differential between the first region and the second region, and to allow the at least one electron beam to propagate from the second region to the first region, the window spaced from the at least one surface by a distance in a range of 1 millimeter to 5 millimeters.

2. The x-ray source of claim 1, wherein the window has a thickness in a range of 0.1 micron to 10 microns and a width in a range of 10 microns to 2000 microns.

3. The x-ray source of claim 1, wherein the window comprises at least one material in the group consisting of: diamond, silicon, silicon nitride, boron nitride, boron carbide, beryllium, titanium, and a combination of two or more thereof.

4. The x-ray source of claim 1, wherein the first region is at a pressure in a range of 0.8 atmosphere to 1 atmosphere and the second region is at a pressure less than atmospheric pressure.

5. The x-ray source of claim 4, wherein the first region comprises air, nitrogen, and/or helium.

6. The x-ray source of claim 1, further comprising an enclosure at least partially bounding the first region, the enclosure substantially opaque to x-rays emitted from the at least one surface in response to being bombarded by the at least one electron beam, the enclosure comprising a portion that is substantially transparent to at least some of the x-rays emitted from the at least one surface in response to being bombarded by the at least one electron beam.

7. The x-ray source of claim 1, wherein the anode assembly comprises:

a shaft configured to rotate about the axis; and an anode mechanically coupled to the shaft, the anode comprising the at least one surface.

8. The x-ray source of claim 7, wherein the anode assembly further comprises:

at least one motor mechanically coupled to the shaft and configured to rotate the shaft; and a plurality of bearing assemblies configured to support the shaft.

9. The x-ray source of claim 8, wherein the at least one motor comprises at least one rotor mechanically coupled to the shaft and at least one stator in magnetic communication with the at least one rotor.

10. The x-ray source of claim 8, wherein the plurality of bearing assemblies comprises a first bearing assembly coupled to a first portion of the shaft and a second bearing assembly coupled to a second portion of the shaft, the anode mechanically coupled to a third portion of the shaft between the first portion and the second portion.

11. The x-ray source of claim 7, further comprising a cooling subsystem in thermal communication with the anode, the cooling subsystem configured to remove heat from the at least one surface at a rate in a range of 100 watts to 5 kilowatts.

12. The x-ray source of claim 11, wherein the cooling subsystem comprises a nozzle configured to spray coolant onto the at least one surface and/or channels extending within the anode and configured to allow coolant to flow through the channels in thermal communication with the anode.

13. An x-ray source comprising:

a first assembly comprising at least one surface configured to rotate about an axis, the at least one surface in a first region, the first assembly configured to generate x-rays in response to electron bombardment of the at least one surface;

an electron-beam source configured to emit at least one electron beam configured to bombard the at least one surface of the first assembly, the electron-beam source comprising:

a housing at least partially bounding a second region, the housing comprising an aperture;

a second assembly comprising at least one electron emitter and an electron optics subsystem, the second assembly configured to generate the at least one electron beam within the second region; and a window configured to hermetically seal the aperture, to maintain a pressure differential between the first region and the second region, and to allow the at least one electron beam to propagate from the second region to the first region, the window spaced from the at least one surface by a distance in a range of 1 millimeter to 5 millimeters.

14. The x-ray source of claim 13, wherein the window comprises at least one material in the group consisting of: diamond, silicon, silicon nitride, boron nitride, boron carbide, beryllium, titanium, and a combination of two or more thereof.

15. The x-ray source of claim 13, wherein the window has a thickness in a range of 0.1 micron to 10 microns and a width in a range of 10 microns to 2000 microns.

16. The x-ray source of claim 13, wherein the first assembly comprises a shaft configured to rotate about the axis and the at least one surface is mechanically coupled to the shaft.

17. The x-ray source of claim 16, wherein the first assembly further comprises:

at least one motor mechanically coupled to the shaft and configured to rotate the shaft; and a plurality of bearing assemblies configured to support the shaft.

18. The x-ray source of claim 13, further comprising a cooling subsystem configured to remove heat from the at least one surface at a rate in a range of 100 watts to 5 kilowatts.

19. The x-ray source of claim 18, wherein the cooling subsystem comprises a nozzle configured to spray coolant onto the at least one surface and/or channels configured to allow coolant to flow through the channels in thermal communication with the at least one surface.

* * * * *